US009326911B2

(12) United States Patent
Wyatt et al.

(10) Patent No.: US 9,326,911 B2
(45) Date of Patent: May 3, 2016

(54) COMPRESSION INTEGUMENT

(71) Applicant: Recovery Force, LLC, Fishers, IN (US)

(72) Inventors: Matthew W. Wyatt, Fishers, IN (US); Lewis Tyson Ross, Franklin, OH (US)

(73) Assignee: Recovery Force, LLC, Fishers, IN (US)

( * ) Notice: Subject to any disclaimer, the term of this patent is extended or adjusted under 35 U.S.C. 154(b) by 496 days.

(21) Appl. No.: 14/027,183

(22) Filed: Sep. 14, 2013

(65) Prior Publication Data

US 2014/0081187 A1 Mar. 20, 2014

Related U.S. Application Data

(60) Provisional application No. 61/701,329, filed on Sep. 14, 2012.

(51) Int. Cl.

| | |
|---|---|
| ***A61H 11/00*** | (2006.01) |
| ***A61H 9/00*** | (2006.01) |
| ***A61H 7/00*** | (2006.01) |
| *A61H 36/00* | (2006.01) |

(52) U.S. Cl.

CPC ..... *A61H 9/0007* (2013.01); *A61H 7/007* (2013.01); *A61H 36/00* (2013.01); *A61H 2201/0207* (2013.01); *A61H 2201/0228* (2013.01); *A61H 2201/1207* (2013.01); *A61H 2201/164* (2013.01); *A61H 2201/165* (2013.01); *A61H 2201/169* (2013.01); *A61H 2201/1635* (2013.01); *A61H 2201/1697* (2013.01); *A61H 2201/501* (2013.01); *A61H 2201/5015* (2013.01); *A61H 2201/5071* (2013.01); *A61H 2201/5082* (2013.01); *A61H 2201/5097* (2013.01); *A61H 2209/00* (2013.01)

(58) Field of Classification Search

CPC ..... A61H 2201/1647; A61H 2201/165; A61H 11/00; A61H 11/02; A61H 2011/005

See application file for complete search history.

(56) References Cited

U.S. PATENT DOCUMENTS

| | | | | | |
|---|---|---|---|---|---|
| 5,997,465 | A * | 12/1999 | Savage | A62B 17/008 | 600/20 |
| 6,010,471 | A * | 1/2000 | Ben-Noon | A61F 5/05816 | 601/149 |
| 6,123,681 | A | 9/2000 | Brown, III | | |
| 7,857,777 | B2 * | 12/2010 | Larson | A61B 17/1325 | 600/13 |

(Continued)

FOREIGN PATENT DOCUMENTS

| | | | |
|---|---|---|---|
| EP | 076118 | A2 | 3/1997 |
| JP | 2005304960 | A | 11/2005 |

(Continued)

*Primary Examiner* — Justine Yu
*Assistant Examiner* — Michael Tsai
(74) *Attorney, Agent, or Firm* — Maginot, Moore & Beck, LLP

(57) ABSTRACT

A compression integument for applying controllable intermittent sequential compression to the limbs of a user comprises an elongated fabric body sized to encircle a limb of a user, one or more compressible pads affixed to a surface of the fabric body facing the limb when the fabric body is wrapped around the limb; one or more tensioning elements integrated into the fabric body or compressible pads and arranged to encircle the limb when the fabric body is wrapped around the limb, and a micro-processor based actuator for selectively actuating the one or more tensioning elements to reduce the effective diameter of the tensioning elements encircling the limb, to thereby apply pressure to the limb by way of the compressible pads.

14 Claims, 5 Drawing Sheets

(56) References Cited

U.S. PATENT DOCUMENTS

| | | | | |
|---|---|---|---|---|
| 7,868,221 | B2 * | 1/2011 | Munch-Fals | A61H 23/02 602/41 |
| 9,161,878 | B1 | 10/2015 | Pamplin et al. | |
| 2006/0122544 | A1 * | 6/2006 | Ciluffo | A41D 13/0015 601/15 |
| 2006/0122546 | A1 * | 6/2006 | Rousso | A61H 11/00 601/79 |
| 2008/0319359 | A1 * | 12/2008 | Moomiaie-Qajar | A61H 11/00 601/152 |
| 2010/0056966 | A1 * | 3/2010 | Toth | A61H 23/0254 601/134 |
| 2012/0232447 | A1 | 9/2012 | Gordon et al. | |
| 2015/0073318 | A1 | 3/2015 | Holschuh et al. | |

FOREIGN PATENT DOCUMENTS

| | | |
|---|---|---|
| WO | WO2006040109 | 4/2006 |
| WO | WO2007079777 | 7/2007 |
| WO | WO2008089787 | 7/2008 |
| WO | WO2009114676 A1 | 9/2009 |

* cited by examiner

COMPRESSION INTEGUMENT

CROSS-REFERENCE TO RELATED APPLICATION

This application is a utility conversion of and claims priority to provisional application Ser. No. 61/701,329, entitled "Automated Constriction Device, filed on Sep. 14, 2012, the entire disclosure of which is incorporated herein by reference.

BACKGROUND

Blood flow disorders can lead to numerous health and cosmetic problems for people. Relatively immobile patients, such as post-operative patients, the bedridden, and those individuals suffering from lymphedema and diabetes. Travelers confined to tight quarters during airline travel, for example, are particularly at risk for the development of thromboses, or blood clots due to decreased blood flow. Varicose veins are another disorder resulting from problems with patient blood flow. Varicose veins are often a symptom of an underlying condition called venous insufficiency. Normal veins have one-way valves that allow blood to flow upward only to return to the heart and lungs. A varicose vein has valves that are not functioning properly. The blood can flow upwards, but tends to pool in the vein because of valve dysfunction. The varicose veins bulge because they are filled with pooled blood. Although varicose veins are often a cosmetic concern, the condition also causes pain, leg heaviness, fatigue, itching, night cramps, leg swelling, and restless legs at night. Varicose vein disease can be treated with various nonsurgical techniques such as sclerotherapy or endovenous laser treatment (EVLT). In some cases enhanced blood flow is essential for quality of life, such as for those individuals suffering from RVD (peripheral vascular disease) and RLS (restless leg syndrome), or women undergoing reconstructive breast surgery suffering from arm pain and fatigue due to poor blood flow.

For some individuals the condition can also be treated by the nightly use of compression stockings. Compression stockings are elastic stockings that squeeze the veins and stop excess blood from flowing backward. These, and other known devices, tend to only provide an initial compression force at a low level that decreases over time upon continued deformation of the stocking.

Many athletes, whether professionals or lay persons, suffer from muscle soreness, pain and fatigue after exercise due to toxins and other workout by-products being released. Recent research has shown that compression garments may provide ergogenic benefits for athletes during exercise by enhancing lactate removal, reducing muscle oscillation and positively influencing psychological factors. Some early research on compression garments has demonstrated a reduction in blood lactate concentration during maximal exercise on a bicycle ergometer. Later investigations have shown improved repeated jump power and increased vertical jump height. The suggested reasons for the improved jumping ability with compression garments include an improved warm-up via increased skin temperature, reduced muscle oscillation upon ground contact and increased torque generated about the hip joint. Combined, these results show that compression garments may provide both a performance enhancement and an injury reduction role during exercises provoking high blood lactate concentrations or explosive-based movements.

Research has also shown that compression garments may promote blood lactate removal and therefore enhance recovery during periods following strenuous exercise. In one test, significant reduction in blood lactate levels in highly fit were observed in males wearing compression stockings following a bicycle ergometer test at 110 percent $VO_2$max. Similar results were obtained in a later study in which a significant reduction in blood lactate concentration and an increased plasma volume was found in twelve elderly trained cyclists wearing compression garments following five minutes of maximal cycling. In another test, wearing compression garments during an 80-minute rest period following the five minutes of maximal cycling were shown to significantly increase (2.1 percent) performance during a subsequent maximal cycling test. It was suggested that increased removal of the metabolic by-products during intense exercise when wearing compression garments may help improve performance. These results suggest that wearing compression garments during recovery periods following high intensity exercise may enhance the recovery process both during and following intense exercise and therefore improve exercise performance.

Compression devices have also been used during recovery periods for athletes following strenuous activity. These devices are generally limited to the athletes legs and typically comprise a series of inflatable bladders in a heel-to-thigh casing. An air pump inflates the series of bladders in a predetermined sequence to stimulate arterial blood flow through the athletes legs. Compression devices of this type are extremely bulky, requiring that the athlete remain generally immobile, either seated or in a prone position.

There is a need for improved devices and associated methods for compressing a portion of a patient's or athlete's body. Of particular need is a device that is comfortable and mobile. Current technology uses plastic (PVC) wrapped around the extremity causing enhanced perspiration and discomfort, so a device that is comfortable and mobile will increase athlete and patient compliance with a treatment regimen.

SUMMARY

In general terms, constrictor devices were developed by vascular surgeons to increase arterial blood flow. These devices apply a massage-like compression to the foot, ankle and calf to circulate blood flow with no known side effects. Current constrictor devices rely upon air pressure from an external air pump to cause constriction compression for patient treatment.

According to this invention the compression device or integument is an apparatus that utilizes shape memory materials in conjunction with elongated compression textiles or fabrics to apply intermittent sequential compression or constriction pressure to a body portion of a person, typically an extremity such as the arms or legs. The compression integument herein is a self-contained unit within a wearable extremity integument. An on-board microprocessor controls the constriction of the memory materials and an on-board power supply provides the power for the compression actuation. By using this self contained low profile unit, a patient or athlete can remain mobile and compliant with the treatment regiment because of the integument's comfort, allowing the user to engage in everyday activities. The integument described herein also reduces costs to the use by eliminating the need to rent a specialized external air pump.

DETAILED DESCRIPTION

Figure 1:
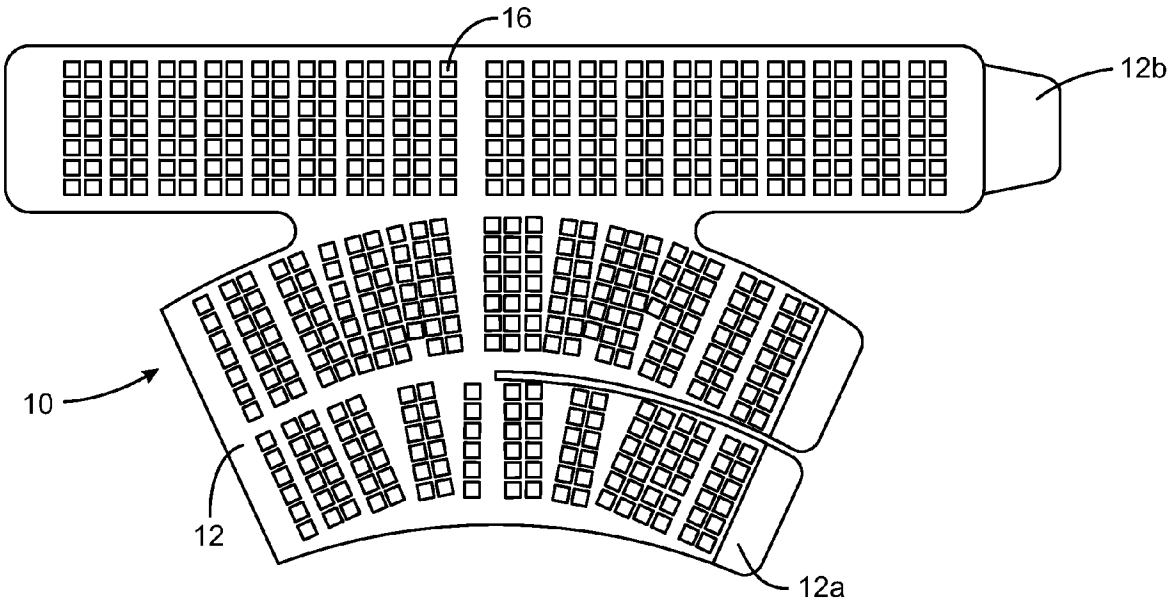
FIG. 1 is a plan view of a compressible fabric body with a plurality of compression pads affixed thereto for use in one embodiment of an integument described herein.
Figure 2:
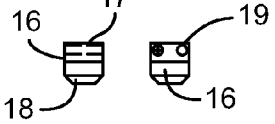
FIG. 2 is are enlarged side and end views of a compression pad shown in FIG. 1.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The present disclosure contemplates a compression integument that provides the same efficacy for blood flow circulation improvement afforded by current pneumatic arterial constriction devices, but in a device that is not restrictive to the patient or athlete during a compression treatment. Current products require the patient to remain relatively immobile in a seated position or prone while air bladders in the wrap are inflated and deflated. Inflation and deflation of the air bladders requires a bulky external pump and hoses, which effectively ties the user to one location. The present invention contemplates a device that can be easily and comfortably worn while allowing full mobility of the patient or athlete.

One embodiment of compression integument 10 is shown in FIGS. 1-5. The integument 10 in the illustrated embodiment is configured to be wrapped around the calf, but it is understood that the integument can be modified as necessary for treatment of other extremities. The integument 10 includes a textile or fabric body 12 having a lower segment 12*a* configured to fit around the foot of the user and an upper segment 12*b* configured to encircle the lower leg. The ends of each segment may include a hook and loop fastener arrangement to permit adjustable fit around the user's foot and calf. Other means for adjustably fastening the body segments about the user's body are contemplated, such as an array of hooks, eyelets, zipper, Velcro or similar fastening devices.

The fabric body 12 is formed of a generally inelastic or only moderately "stretchable" material that is suited for contact with the skin of the user. The material of the fabric body may be a breathable material to reduce perspiration or may be a generally impermeable material to enhance heating of the body part under compression treatment. It is understood that the configuration of the body 12 shown in FIG. 3 can be modified according to the body part being treated. For instance, the fabric body 12 may be limited to the upper segment 12*a* to wrap the calf, thigh, bicep or forearm only. The body may also be configured to fit at the knee or elbow of the user.

In one embodiment, the fabric body can be a compressible body having a thickness to accommodate the tensioning elements described herein. In another embodiment, the compressibility of the integument is accomplished by one or more compressible pads. In the embodiment illustrated in FIGS. 1-3, the fabric body includes an array of pads 16 that are configured to transmit pressure from the integument as it is compressed. As explained in more detail herein, the pressure is sequentially applied to certain groups of pads when wrapped around the extremity to apply alternating pressure to specific locations of the patient's or athlete's extremity, such as the ankle and lower calf in the illustrated embodiment. In certain compression protocols, the compression force applied to the user can be as high as 10 psi, although the compression force in most applications is only about 5 psi. Thus, the pads are configured to uniformly transmit this range of pressures. In one specific embodiment, each pad is in the form of a 1 cm×1 cm rectangle. The pads may be provided in rows separated by 0.25 cm to about 0.75 cm, and preferably about 4 cm in order to provide an optimum pressure profile to the patient/athlete's limb. Each pad includes an inner portion 17 and a outer portion 18, as shown in the detail view of FIG. 2. In one embodiment, the inner portion is formed of a material to provide a hard generally non-compressible surface, such as a nylon having a durometer value of about 110. The outer portion 18 is formed of a wicking compressible material, such as a soft compressible memory foam that is adapted to lie against the patient's skin. The inner portion 17 is fastened or affixed to the fabric body 12 in a suitable manner, such as by use of an adhesive. The inner portion 17 of each pad 16 is provided with one or more, and preferably two, bores 19 therethrough to receive a tensioning element as described herein. An additional layer of material may line exposed surface of the inner portion which contacts the extremity surface. For instance, the integument may be provided with a soft, breathable sheet of material that is affixed to the fabric body to cover the compressible pads 16. The additional sheet may be removable fastened, such as by hook and loop fasteners at its ends.

Figure 3:
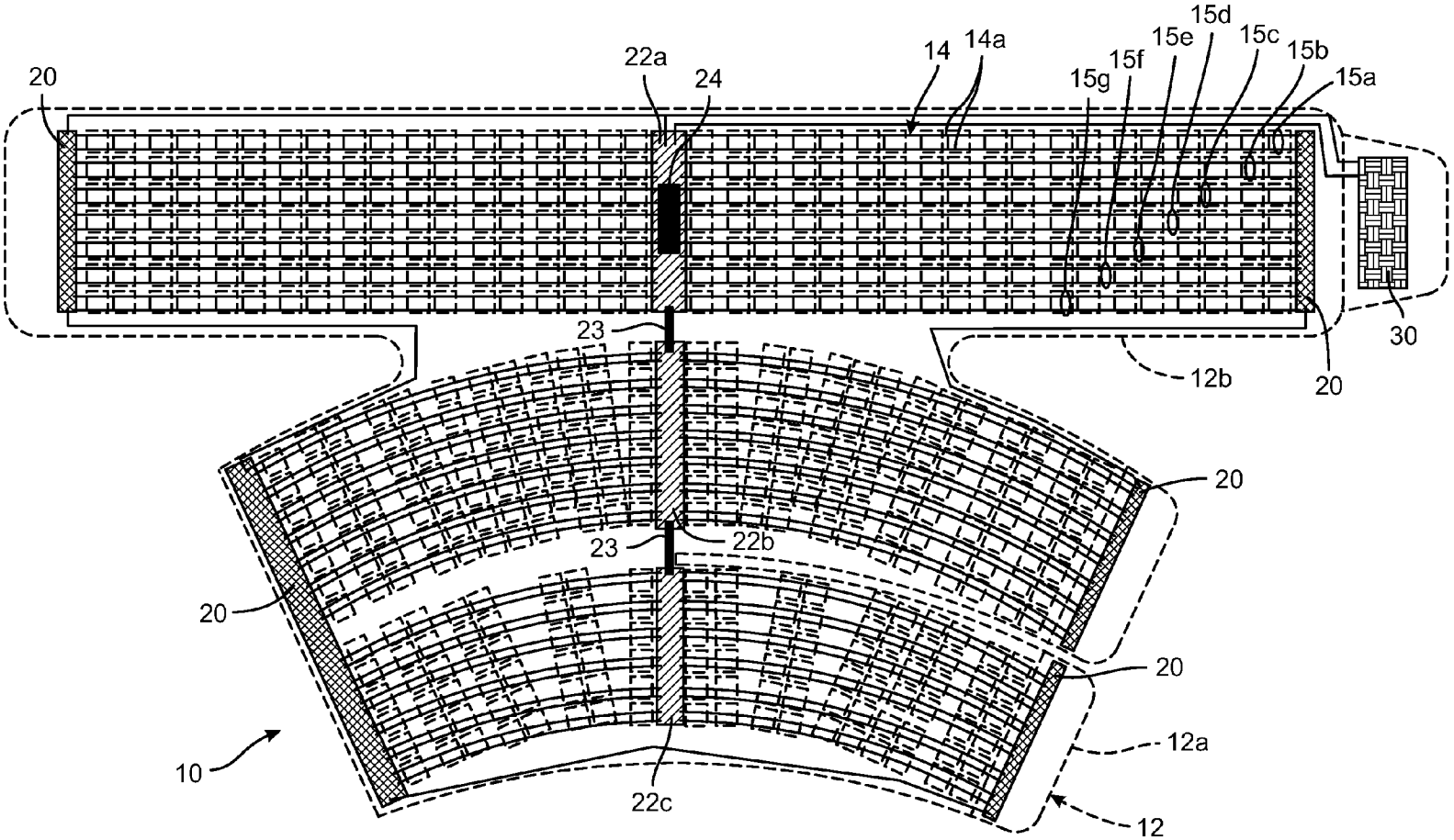
FIG. 3 is a plan view of an integument according to one disclosed embodiment.

In accordance with one feature of the present invention, the integument is provided with a plurality of tensioning elements in the form of a wire formed of a "shape memory" material or alloy that shrinks when a current is applied to the wire, and that returns to its original "memory" configuration when the current is removed or changed. As shown in FIG. 3, the compression integument 10 includes a "memory" wire array 14 that spans the width and length of each segment 12*a*, 12*b* of the fabric body 12, and that extends through the bores 19 in each compression pad 16. In certain embodiments, the memory wire can include wires formed of Nitinol or Dynalloy having a diameter of 0.008 in. In one specific embodiment, the memory wires 14 are configured so that a current of 0.660 amp passing through each wires causes it to shrink sufficiently to exert a force of about 1.26 lbf to 4 lbf.

The fabric body 12 may be provided with pockets or sleeves to receive and retain the compressible pads 16. It is further contemplated that each row of compressible pads is replaced by a single elongated compressible cushion element with the bores 16 passing therethrough to receive the corresponding pairs of memory wires 14*a*. It is further contemplated that the fabric body 12 may be configured so that the compressible pads or elongated cushion elements are sewn into the body.

As reflected in FIG. 3 each pair of wires 14*a* passing through a row of compression pads 16, or elongated cushion elements, corresponds to a single channel that can be individually actuated during a compression treatment. Each channel, or wire pair, 14*a* is connected to a microcontroller as described herein. In the illustrated embodiment, the upper segment 12*b* includes seven such channels 15*a*-15*g*. The lower segment 12*a* includes a wire array with seven channels and a wire array with six channels. Each row or channel of wires 14*a* in the wiring array 14 terminates at a negative anode or ground plane 20 at the opposite ends of each body segment 12*a*, 12*b*. Each channel, such as the channels 15*a*-15*g*, is electrically connected to a corresponding distribution circuit board 22*a*-22*c*. A flexible multi-conductor cable 23 connects the distribution circuit boards between segments of the fabric body 12 so that the distribution circuit boards do not interfere with the ability of the integument 10 to be wrapped snugly about the user's extremity.

Figure 4:
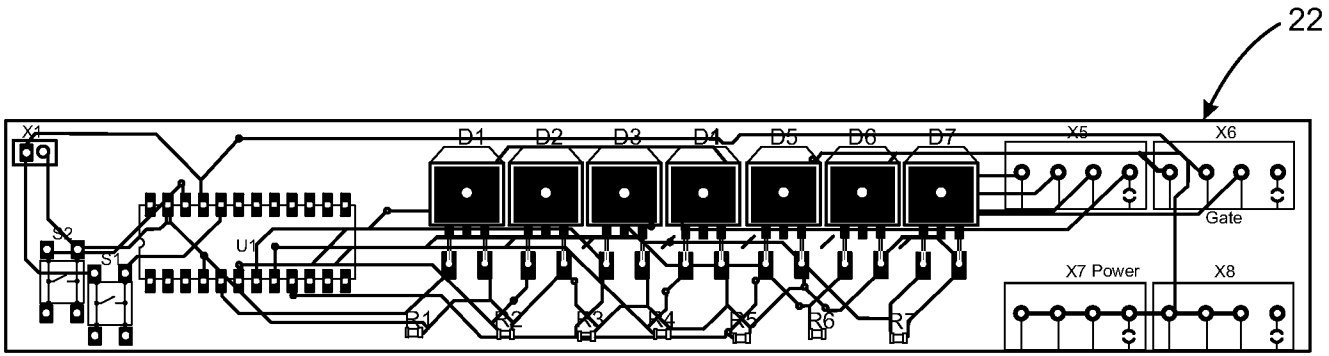
FIG. 4 is a top view of a circuit board for use in the integument shown in FIG. 3.

One of the distribution circuit boards 22*a* carries a microprocessor 24 that controls the sequence and magnitude of the current applied to the memory wires in each channel. As shown in FIG. 4, the distribution circuit boards 22 can include surface mount resistors and power mosfets electrically connected to the wire pairs of each channel. The microcontroller 24 is preferably not hard-wired to the circuit board 22*a* to permit replacement of one pre-programmed microcontroller with a differently programmed microcontroller. In one embodiment, a microcontroller may be preprogrammed with a particular compression sequence for a particular user and a particular integument. Other compression protocols may be preprogrammed into other microcontrollers that can be selected by the user or physical therapist as desired.

Figure 5:
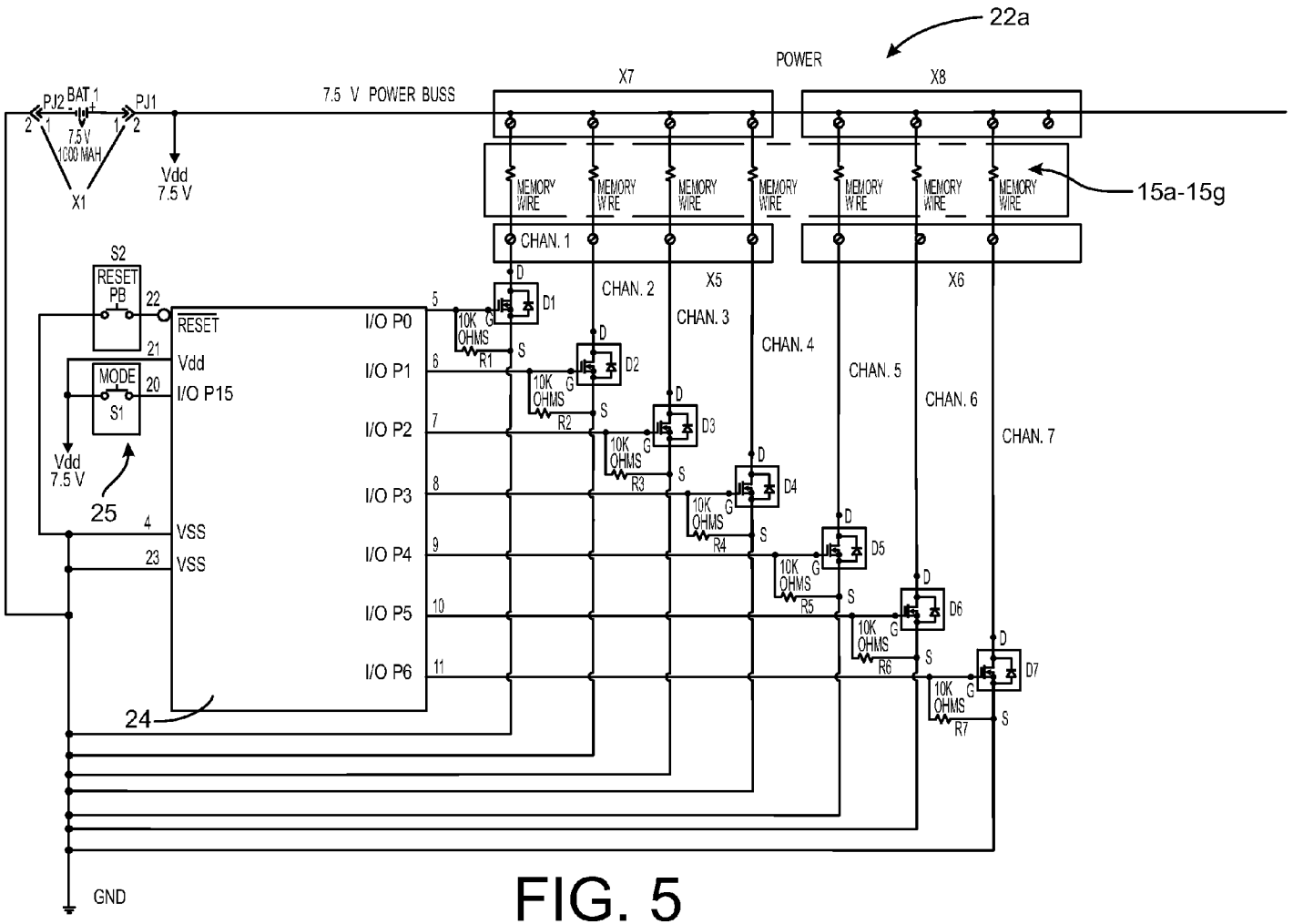
FIG. 5 is a circuit diagram for the electrical circuit of the integument shown in FIG. 3.

Details of the circuit board 22*a* and microcontroller 24 are shown in the circuit diagram of FIG. 5. The microcontroller may be a Parallax microcontroller Part No. BS2-IC. The microcontroller is provided with a switch array 25 which includes a mode switch S1 and a reset switch S2. The switches are accessible by the user to operate the integument 10. Alternatively, the switches may be integrated into a remote communication module capable of wireless communication from outside the compression integument. The circuit board may thus incorporate a transmitter/receiver component coupled to the switches S1, S2, such as an RF, Bluetooth, wifi or Spec 802.11g device. The integument 10 can be equipped with a USB type connection for charging the power supply 30 and for data download or upload. The mirocontroller may thus include a memory for storing actuation data, and may further integrate with sensors on the circuit boards that can sense and "report" pressure and temperature, for instance. In one aspect, the microcontroller 24 is thus configured to communicate with a handheld device, such as an iPad, iPod, smart phone, or with another device equipped with wireless transmission/receiving capabilities, such as a PC or laptop computer. The remote device can serve to receive and record actuation data, and can act as a master controller for the micro-controller 24, whether to activate either of the two switches, or in a more advanced configuration to remotely configure or program the micro-controller.

A power supply 30 is provided that is connected to the distribution circuit boards 22*a*-22*c* and grounded to the negative anodes 20. In one embodiment, the power supply 30 is a 7.5 volt, 40 AH lithium cell array contained with a pouch defined in the fabric body 12. The pouch may be configured to insulate the user from any heat build-up that might occur when the battery is powering the integument 10. The power supply 30 is preferably a rechargeable battery that can be recharged through the remote link to the microcontroller described above.

The micro-controller 24 implements software for controlling the sequence and pattern of compression that will be followed through a treatment process. In one embodiment, the micro-controller is activated and controlled by a remote device, as described above. Additionally, the micro-controller can have basic user controls embedded in the integument, such as a control panel affixed to the outside of one of the fabric segments 12*a*, 12*b*.

The manner in which pressure is applied to the user's body depends upon the number and arrangement of the pads 16 and channels 15. In the illustrated embodiment of FIG. 2, the pads may be actuated from the lowermost channel 15*g* to the uppermost channel 15*a*, with successive channels being gradually deactivated, or expanded, and gradually activated, or contracted. Different activation patterns can be pre-programmed into the micro-controller or administered by the remote device as described above. When a channel is activated, the micro-controller 24 directs current to the specific channel which causes the memory wires 14*a* to contract or shrink, thereby reducing the effective diameter of the memory wires or elongated materials when wrapped around a limb. This reduction in diameter translates to an application of pressure by way of the pads 16 in the same manner as the air-inflatable devices of the prior art. When the current is removed or changed, the "memory" feature of the wire allows it to return to its deactivated or expanded condition, thereby removing pressure from the associated compressible pads.

In an alternative embodiment the multiple 1×1 pads in two or three adjacent rows may be replaced by an elongated compressive pad extending along each side of the fabric body 12. The memory wires 12*a* are embedded with the elongated pad in the manner described above and each row of elongated compressive pads can be actuated in the same manner as the plurality of smaller pads described above.

Figure 7:
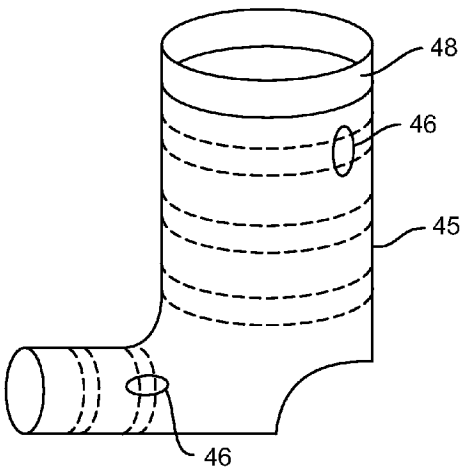
FIG. 7 is a perspective view of an exterior sock for use with the interior sock shown in FIG. 6 for the compression integument according to one disclosed embodiment.
Figure 6:
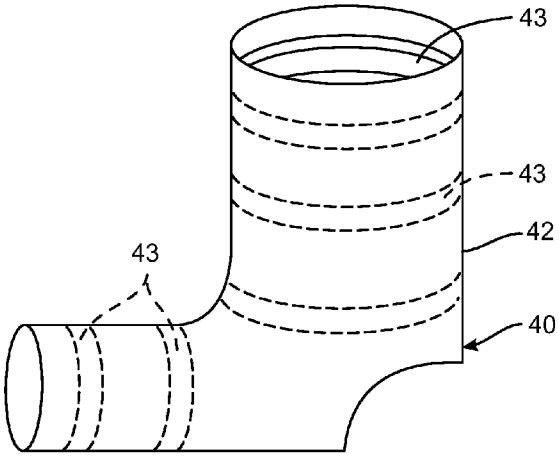
FIG. 6 is a perspective view of an interior sock for a compression integument according to one disclosed embodiment.

In an alternative embodiment, an integument 40 may be formed by the combination of an interior sock 42, shown in FIG. 6, and an exterior sock 45, show in FIG. 7. The interior sock 42 incorporates compression pads 43 that encircle the limb and which may be an elongated cushion, as described above, or may be similar to pads 16. The pads 43 may be thermally conductive to convey heat generated by the memory wires to the user's skin. Alternatively, the pads may be thermally insulating to minimize the transmission of heat to the user. The outer sock 45 is integrated over the inner sock 42 and includes the memory wires 46, each aligned with a corresponding pad. The electronics, including the power supply and micro-controller, may be incorporated into a ring 48 at the top of the sock-shaped integument 40.

Figure 8:
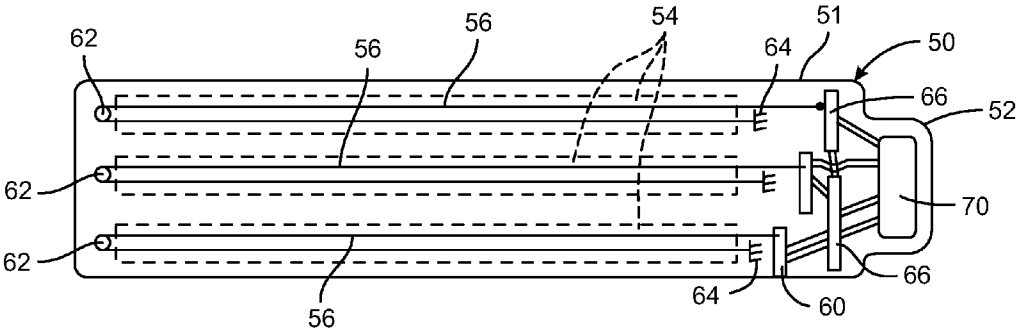
FIG. 8 is a plan view of an integument according to a further embodiment utilizing a micro-motor to activate a tensioning element.

In another embodiment, the tensioning elements are generally non-extensible wires that are pulled by a motor carried by the integument. In particular, an integument 50 shown in FIG. 8 includes a fabric body 51 with a extension 52 that may be configured with a fastening feature, such as the hook and loop fastener described above, that engages the opposite ends of the body to wrap the integument about a patient's limb. The integument may be provided with a number of elongated compressive pads 54 arranged in rows along the length of the fabric body. The pads may be configured as described above, namely to incorporate the bores 19 for receiving tensioning wires therethrough. However, unlike the embodiment of FIGS. 1-2, the tensioning wires of integument 50 are not memory wires, but are instead generally non-extensible wires 56. One end of each wire 56 is connected to a drive motor 60, then the wire passes through a compressible pad 54, around a pulley 62 at the opposite end of the fabric body 51, and then back through the compressible pad. The end of the wire 56 is "grounded" or fastened to the fabric body 51, as shown in FIG. 8. Each compressible pad includes its own wire 56 and each wire may be driven by its own motor 60. The motors 60 are connected to a micro-controller 66 and to a power supply 70, which may be similar to the power supply 30 described above. The micro-controller is configured to activate each motor 60 according to a prescribed compression protocol.

In order to ensure that the integument 50 preserves the mobility and ease of use, the motors 60 may be strip-type motor, such as the Miga Motor Company "HT Flexinol model. The motor is thus compact and adapted for placement across the width of the fabric body 51, as shown in FIG. 8. The motors will not inhibit the compression of the integument 50 or otherwise cause discomfort to the wearer. The wires 56 may be plastic wires for low-friction sliding relative to the compressible pads 54, and are generally non-extensible so that pulling the wires translates directly into a compressive force applied through the pads.

In an alternative embodiment, the wires 56 may be replaced by a mesh that is fastened at one end to a corresponding motor 60 and is "grounded" or fastened to the fabric body 51 at the opposite end. In this embodiment, the mesh is "free floating" between the compressible pads and an outer fabric cover. The mesh may be sandwiched between Mylar layers to reduce friction as the mesh is pulled by the motors.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A compression integument for applying controllable compression to the limb of a user, comprising:

an elongated compressible body sized to encircle a limb of a user, the body including a wearable fabric, one or more compressible pads, and a fastener arrangement at opposite ends of the body configured for releasable engagement to wrap the body around the limb;

one or more tensioning elements integrated into the compressible body and arranged to encircle the limb when the body is wrapped around the limb; and a micro-processor based actuator for selectively actuating the one or more tensioning elements to reduce the effective diameter of the tensioning elements encircling the limb, to thereby apply pressure to the limb by way of the compressible body; wherein the one or more compressible pads are affixed to a surface of the wearable fabric facing the limb of the user, wherein the one or more tensioning elements are integrated into the one or more compressible pads; wherein the one or more compressible pads includes a rigid portion affixed to the wearable fabric and a relatively compressible portion affixed to the rigid portion and arranged to face the patient's limb when the integument is wrapped there around; and wherein one of the rigid portion and the compressible portions of each pad defines at least one bore for receiving tensioning element therethrough.

2. The compression integument of claim 1, wherein:

the one or more tensioning elements are memory wires that shrink in length upon application of a current; and the micro-processor based actuator is configured to selectively apply a current to the one or more memory wires.

3. The compression integument of claim 2, wherein:

the compressible body includes at least two segments, each segment configured to encircle a different part of the user's body; and the micro-processor based actuator includes a circuit board integrated into one segment including a microcontroller for controlling the actuation of the tensioning elements, a distribution board in each of the other at least two segments, and a ground plane in each of the segments, wherein the memory wires are electrically connected between a ground plane and a circuit board in a corresponding segment of the compressible body, and further wherein the circuit boards are electrically connected by a flexible multiconductor.

4. The compression integument of claim 1, wherein:

the one or more tensioning elements are generally non-extensible wires; and the micro-processor based actuator includes a motor for each non-extensible wire, wherein one end of each wire is connected to a corresponding motor and the opposite end of each wire is fastened to the compressible body, and wherein the motor is operable to pull the non-extensible wire to thereby reduce its effective length in the integument.

5. The compression integument of claim 4, wherein each non-extensible wire is provided with a pulley at an end of the compressible body opposite the motor and each non-extensible wire is fastened to the fabric body at a location between the pulley and the motor.

6. The compression integument of claim 1, wherein the wearable fabric including the fastener arrangement.

7. The compression integument of claim 6, wherein the one or more compressible pads include an elongated cushion sized to extend substantially along a length of the wearable fabric encircling the user's limb.

8. The compression integument of claim 1, wherein the one or more compressible pads includes a plurality of pads arranged in a plurality of rows around the length of the wearable fabric encircling the user's limb.

9. The compression integument of claim 1, wherein each pad defines two bores for receiving a pair of tensioning elements, each pair of tensioning elements selectively actuated together by the micro-processor based actuator.

10. The compression integument of claim 1, further comprising a power supply carried by the compressible body.

11. The compression integument of claim 1, wherein the micro-processor based actuator is configured for remote communication with an device external to the user.

12. The compression integument of claim 11, wherein the external device is a handheld device capable of wireless communication with the micro-processor based actuator.

13. The compression integument of claim 1, wherein the micro-processor based actuator includes a circuit board integrated into the compressible body and a microcontroller mounted to the circuit board, the microcontroller programmed to actuate the tensioning elements according to a compression protocol stored in a memory of the microcontroller.

14. The compression integument of claim 13, wherein the microcontroller is removably mounted to the circuit board for replacement by another microcontroller programmed to actuate the tensioning elements according to another different compression protocol.

* * * * *